US007219506B2

(12) United States Patent
Kang et al.

(10) Patent No.: US 7,219,506 B2
(45) Date of Patent: May 22, 2007

(54) METHOD FOR ESTIMATING INLET AND OUTLET AIR CONDITIONS OF AN HVAC SYSTEM

(75) Inventors: Pengju Kang, Hartford, CT (US); Mohsen Farzad, Glastonbury, CT (US); Alan Finn, Hebron, CT (US); Payman Sadegh, Manchester, CT (US); Slaven Stricevic, Willimantic, CT (US)

(73) Assignee: Carrier Corporation, Syracuse, NY (US)

( * ) Notice: Subject to any disclaimer, the term of this patent is extended or adjusted under 35 U.S.C. 154(b) by 246 days.

(21) Appl. No.: 10/973,009

(22) Filed: Oct. 25, 2004

(65) Prior Publication Data

US 2006/0086111 A1 Apr. 27, 2006

(51) Int. Cl.

| | |
|---|---|
| ***F25D 17/04*** | (2006.01) |
| ***F25D 23/12*** | (2006.01) |
| ***F25B 49/00*** | (2006.01) |
| ***F25B 1/00*** | (2006.01) |

(52) U.S. Cl. ..... 62/176.6; 62/176.3; 62/228.1

(58) Field of Classification Search ..... 62/176.6, 62/176.3, 228.1, 228.3, 229, 213, 126

See application file for complete search history.

(56) References Cited

U.S. PATENT DOCUMENTS 5,435,146 A * 7/1995 Clark ..... 62/126

FOREIGN PATENT DOCUMENTS

JP 58168834 A * 10/1983

OTHER PUBLICATIONS

International Search Report dated Oct. 3, 2006.

* cited by examiner

*Primary Examiner*—Chen Wen Jiang
(74) *Attorney, Agent, or Firm*—Carlson, Gaskey & Olds

(57) ABSTRACT

The temperature of the air exiting an evaporator and the relative humidity of the air entering and exiting the evaporator can be calculated by using existing sensors in a vapor compression system. The temperature of the air exiting the evaporator is calculated by using the detected temperature of the air entering the evaporator, the saturation temperature of the air, and a bypass factor. The relative humidity of the air entering and exiting the evaporator are then estimated using a psychrometric chart. By using the existing sensors to determine the temperature of the air exiting the evaporator and the relative humidity of the air entering and exiting the evaporator, the load requirement of the vapor compression system can be calculated without employing additional sensors. The system capacity of the vapor compression system can be matched to the load requirement to allow the effective use of electric power.

19 Claims, 2 Drawing Sheets

METHOD FOR ESTIMATING INLET AND OUTLET AIR CONDITIONS OF AN HVAC SYSTEM

BACKGROUND OF THE INVENTION

The present invention relates generally to a method for estimating the inlet and outlet air conditions of an HVAC system to determine the load requirements of the system.

The greenhouse gases emitted to the atmosphere by an HVAC system can be reduced by efficiently utilizing electric power. Electric power can be efficiently utilized by employing capacity control that matches the system capacity to the load requirements of the HVAC system. Capacity control utilizes various refrigerant and air conditions to determine the load requirement of the HVAC system. Sensors are generally utilized in an HVAC system to detect the pressure and the temperature of the refrigerant entering and exiting the compressor, the temperature of the refrigerant entering and exiting the evaporator, and the temperature of the air entering the evaporator. Once the load requirements are known, the compressor can be control so that the system capacity matches the load requirements.

The temperature of the air exiting the evaporator and the relative humidity of the air entering and exiting the evaporator also need to be detected to employ capacity control. However, a drawback is that additional sensors must be installed to monitor the temperature of the air exiting the evaporator and the relative humidity of the air entering and exiting the evaporator. In the prior art, humidity sensors, dry bulb sensors, and wet bulb temperature sensors were added to the vapor compression system to monitor these conditions.

There are several drawbacks to installing additional sensors in the HVAC system. For one, employing additional sensors is expensive. Additionally, the measurements provided by some sensors may not be reliable due to the complex dynamics of a thermodynamic system. For example, if a sensor is employed to measure the air temperature of the air exiting the evaporator, the turbulence in the outlet air created by a fan can affect the temperature reading. It would be beneficial to determine the temperature of the air exiting the evaporator and the relative humidity of the air entering and exiting the evaporator without using additional sensors.

Therefore, the present invention provides a method that utilizes existing sensors to provide an accurate estimation of the inlet and outlet air conditions of the evaporator that are needed for capacity control without additional cost to the system and also provides the information needed for the diagnostic/prognostics of the HVAC system as well as overcoming the other drawbacks and shortcomings of the prior art.

SUMMARY OF THE INVENTION

A vapor compression system provides cool air to an area when operating in a cooling mode. Refrigerant is compressed to a high pressure in a compressor and is cooled in a condenser. The cooled refrigerant is expanded to a low pressure in an expansion device. After expansion, the refrigerant flows through the evaporator and accepts heat from the air, cooling the air. The refrigerant then returns to the compressor, completing the cycle.

Several refrigeration and air properties of the vapor compression system are detected to calculate the load demand of the vapor compression system. The vapor compression system includes sensors that detect the compressor suction temperature, the compressor discharge temperature, the compressor suction pressure, the compressor discharge pressure, the inlet temperature of the refrigerant entering the evaporator, the outlet temperature of the refrigerant exiting the evaporator, and the inlet temperature of the air entering the evaporator. The temperature of the air exiting the evaporator, the relative humidity of the air entering the evaporator, and the relative humidity of the air exiting the evaporator are determined using the values detected by the sensors.

The outlet temperature of the air exiting the evaporator is calculated by using the detected inlet temperature of the air entering the evaporator, the saturation temperature of the air (which is approximately equal to the refrigerant saturation temperature) and a bypass factor of the evaporator.

The relative humidity of the air entering and exiting the evaporator can then calculated. On a psychrometric chart, the dry bulb temperature is on the horizontal axis, and the humidity ratio is on the vertical axis. A first point is plotted at the intersection of a vertical line extending from the saturation temperature of the refrigerant and the saturation line. The air exiting the evaporator is near saturation, and the relative humidity of the air exiting the evaporator is approximately 95% of the saturation line. Therefore, the relative humidity line of the air exiting the evaporator is known. A second point is defined at the intersection of a vertical line extending from the outlet temperature of the air exiting the evaporator and the relative humidity line of the air exiting the evaporator.

A line connecting the first point and the second point is extended until it intersects a vertical line extending vertically from the inlet temperature of the air entering the evaporator at a third point. The third point represents the relative humidity of the air entering the evaporator.

By using the existing sensors to determine the temperature of the air exiting the evaporator and the relative humidity of the air entering and exiting the evaporator, the load requirement of the vapor compression system can be calculated without employing additional sensors. Once the load requirements are known, the system capacity can be matched to the load requirement, allowing the electric power of the vapor compression system to be used effectively.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
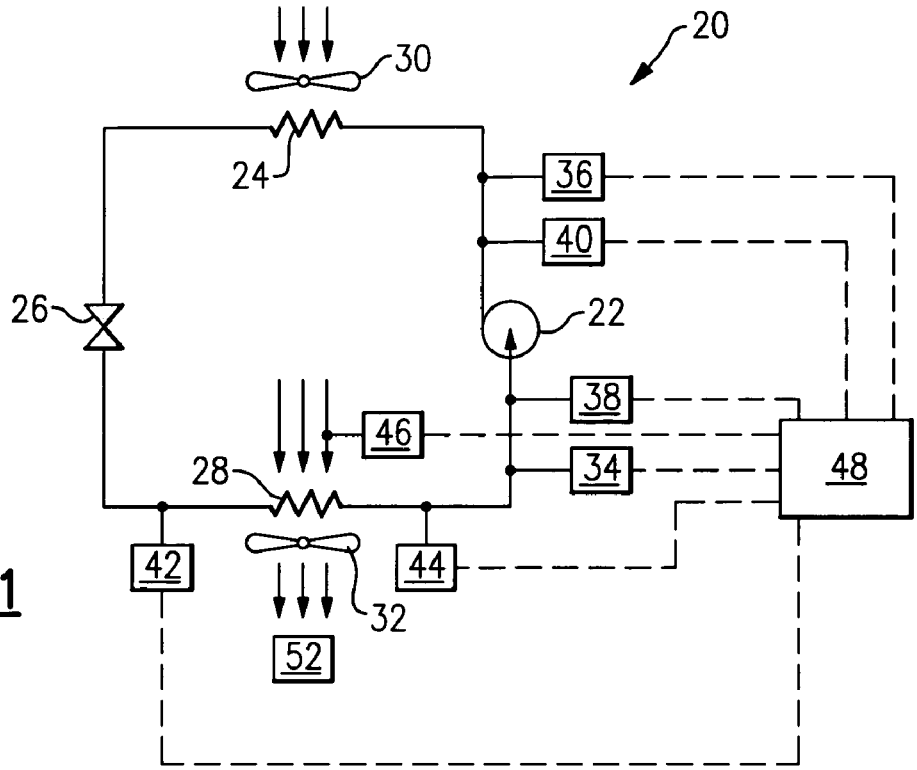
FIG. 1 illustrates a vapor compression system including sensors used to detect conditions of the air and the refrigerant flowing through the vapor compression system.

FIG. 1 illustrates a vapor compression system 20 including a compressor 22, a condenser 24, an expansion device 26, and an evaporator 28. Refrigerant circulates though the closed circuit vapor compression system 20.

When the vapor compression system 20 is operating in a cooling mode, the refrigerant exits the compressor 22 at a high pressure and a high enthalpy and flows through the condenser 24. In the condenser 24, the refrigerant rejects heat to a fluid medium, such as water or air, and is condensed into a liquid that exits the condenser 24 at a low enthalpy and a high pressure. If the fluid medium is air, a fan 30 is employed to direct the fluid medium over the condenser 24. The cooled refrigerant then passes through the expansion device 26, and the pressure of the refrigerant drops. After expansion, the refrigerant flows through the evaporator 28. In the evaporator 28, the refrigerant accepts heat from air, exiting the evaporator 28 at a high enthalpy and a low pressure. A fan 32 blows the air over the evaporator 28, and the cooled air is then used to cool an area 52.

When the vapor compression system 20 is operating in a heating mode, the flow of the refrigerant is reversed using a four-way valve (not shown). When operating in the heating mode, the condenser 24 operates as an evaporator, and the evaporator 28 operates as a condenser.

Capacity control is utilized to match the system capacity of the vapor compression system 20 to the load requirement of the vapor compression system 20 and therefore effectively use electric power. The load requirement is the required heat exchange that occurs at the evaporator 28. When the load requirement is known, the compressor 22 can be controlled such that the load requirement of the vapor compression system 20 is met.

Figure 2:
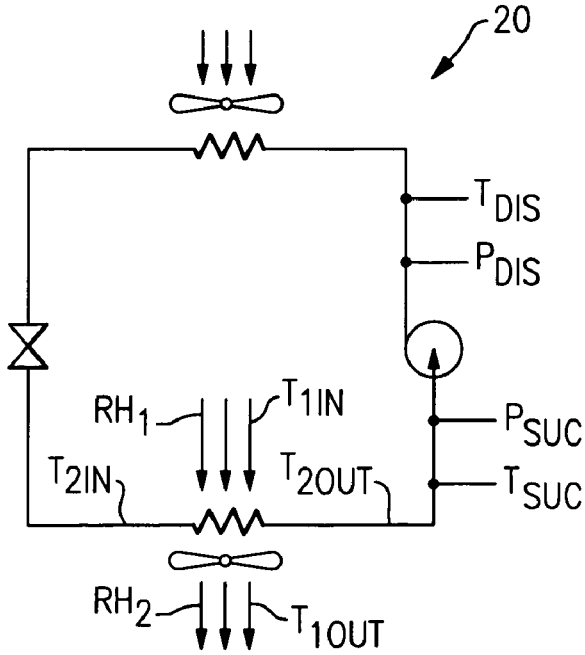
FIG. 2 illustrates a vapor compression system showing the sensed values needed to determine the load requirements of the vapor compression system.

Several variables are needed to calculate the load demand as an integral part of the capacity control task. As shown in FIG. 2, the variables are 1) the compressor suction temperature $T_{suc}$, 2) the compressor discharge temperature $T_{dis}$, 3) the compressor suction pressure $P_{suc}$, 4) the compressor discharge pressure $P_{dis}$, 5) the inlet temperature of the refrigerant entering the evaporator $T_{2in}$, 6) the outlet temperature of the refrigerant exiting the evaporator $T_{2out}$, 7) the inlet temperature of the air entering the evaporator $T_{1in}$, 8) the outlet temperature of the air exiting the evaporator $T_{1out}$, 9) the relative humidity of the air entering the evaporator $RH_1$, and 10) the relative humidity of the air exiting the evaporator $RH_2$.

It is difficult to accurately measure the outlet temperature of the air exiting the evaporator $T_{1out}$ due to the non-homogeneous nature of the turbulent airflow produced by the fan 32. Measuring the relative humidities $RH_1$ and $RH_2$ of the air entering or exiting the evaporator 28, respectively (the wet bulb temperature) is expensive and possibly inaccurate. Therefore, only the sensors that measure the compressor suction temperature $T_{suc}$, the compressor discharge temperature $T_{dis}$, the compressor suction pressure $P_{suc}$, the compressor discharge pressure $P_{dis}$, the inlet temperature of the refrigerant entering the evaporator $T_{2in}$, the outlet temperature of the refrigerant exiting the evaporator $T_{2out}$, and the inlet temperature of the air entering the evaporator $T_{1in}$ are installed in the vapor compression system 20. In the present invention, the outlet temperature of the air exiting the evaporator $T_{1out}$, the relative humidity of the air entering the evaporator $RH_1$, and the relative humidity of the air exiting the evaporator $RH_2$ are calculated using the values detected by the installed sensors.

Returning to FIG. 1, the vapor compression system 20 includes a sensor 34 that detects the compressor suction temperature $T_{suc}$, a sensor 36 that detects the compressor discharge temperature $T_{dis}$, a sensor 38 that detects the compressor suction pressure $P_{suc}$, a sensor 40 that detects the compressor discharge pressure $P_{dis}$, a sensor 42 that detects the inlet temperature of the refrigerant entering the evaporator $T_{2in}$, a sensor 44 that detects the outlet temperature of the refrigerant exiting the evaporator $T_{2out}$, and a sensor 46 that detects the inlet temperature of the air flowing into the evaporator $T_{1in}$. The sensors 34, 36, 38, 40, 42, 44 and 46 all communicate with a control 48.

By employing the sensors 34, 36, 38, 40, 42, 44 and 46 that are usually installed in the vapor compression system 20, the outlet temperature of the air exiting the evaporator $T_{1out}$, the relative humidity of the air entering the evaporator $RH_1$, and the relative humidity of the air exiting the evaporator $RH_2$ can be calculated without employing the additional sensors.

A bypass factor BPF of the evaporator 28 represents the amount of air that is bypassed without direct contact with the coil of the evaporator 28. The bypass factor BPF depends upon the number of fins in a unit length of the coil (the pitch of the coil fins), the number of rows in the coil in the direction of airflow, and the velocity of the air. The bypass factor BPF of the coil decreases as the fin spacing decreases and the number of rows increases. The bypass factor BPF is defined as:

$$BPF = \frac{T_{1out} - T_s}{T_{1in} - T_s} \quad \text{(Equation 1)}$$

when the evaporator 28 is a cooling coil $$BPF = \frac{T_s - T_{1out}}{T_s - T_{1in}} \quad \text{(Equation 2)}$$

when the evaporator 28 is a heating coil

The saturation temperature of the air is represented by $T_s$. The saturation temperature of the air $T_s$ is approximately equal to the saturation temperature of the refrigerant. The saturation temperature of the refrigerant is calculated using the compressor suction pressure $P_{suc}$ and the refrigerant property. The refrigerant property is a known value that depends on the type of refrigerant used. Typically, the bypass factor BPF is below 0.2.

Figure 3:
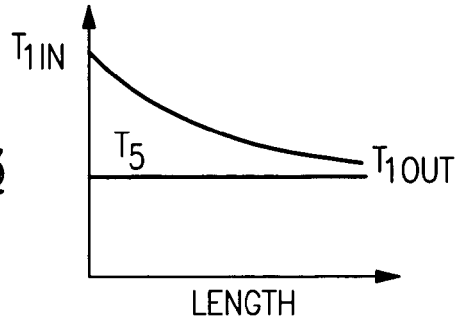
FIG. 3 illustrates a graph showing the temperature of the air flowing over a evaporator as the air travels through the evaporator.

FIG. 3 illustrates a graph showing the temperature of the air as it passes over the coil of the evaporator 28. As shown, as the air travels over and along the length of the coil of the evaporator 28, the outlet temperature of the air exiting the evaporator $T_{1out}$ decreases almost to the saturation temperature of the air $T_s$.

The heat transfer rate of the evaporator 28 is defined as:

$$Q = UA \times LMTD \quad \text{(Equation 3)}$$

The heat transfer rate is represented by the variable Q (W). The variable U represents the overall heat transfer coefficient ($W/m^2K$), the variable A represents the surface area of the coil of the evaporator 28, and the variable LMTD represents the logarithmic mean temperature difference.

The variable logarithmic mean temperature difference is defined as:

$$LMTD = \frac{T_{1in} - T_{1out}}{\log_e\left(\frac{T_{1in} - T_s}{T_{1out} - T_s}\right)} \quad \text{(Equation 4)}$$

Equation 1 can be inserted into Equation 4, and the variable logarithmic mean temperature difference is defined as:

$$LMTD = \frac{T_{1in} - T_{1out}}{\log_e\left(\frac{1}{BPF}\right)} \quad \text{(Equation 5)}$$

The heat transfer rate Q can also be calculated from the airside (the load demand) using the following equation:

$$\dot{Q} = \frac{\dot{m}_1 c_{Pl}(T_{1in} - T_{1out})}{SHR} \quad \text{(Equation 6)}$$

In this equation, $m_1$ represents the mass flow rate of air (kg/s), $c_{p1}$ represents the specific heat of dry air (J/kgK), and SHR represents the sensible heat ratio. The inlet temperature of the air flowing into the evaporator $T_{1in}$ and the outlet temperature of the air flowing out of the evaporator $T_{1out}$ are in Celsius (° C.).

Combining Equation 3 and Equation 6 results in the following equation:

$$BPF = e^{-\frac{UA \cdot SHR}{c_{Pl}\dot{m}_1}} \quad \text{(Equation 7)}$$

Figure 4:
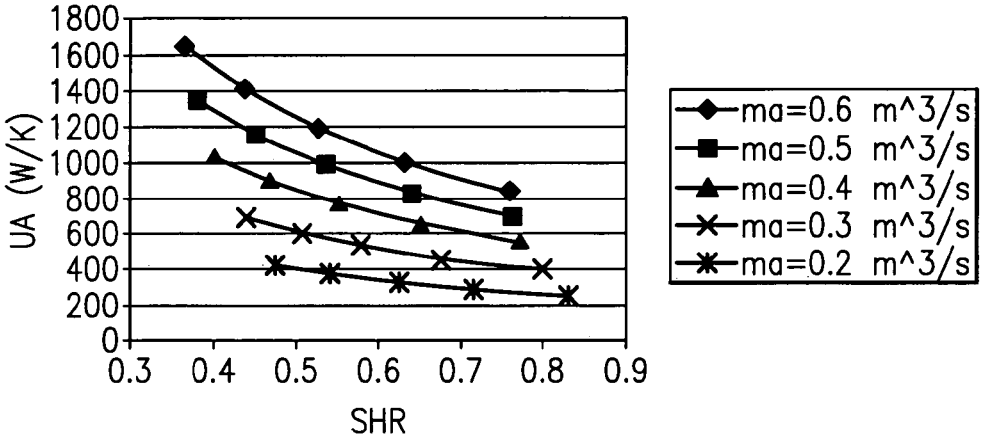
FIG. 4 illustrates a graph showing data about the evaporator.

As shown in FIG. 4, for a coil of an evaporator 28 with a two-phase refrigerant flow, the value UA is a function of the sensible heat ratio SHR and the mass flow rate of air $m_1$. The evaporator 28 is used in a 30 HP heat pump system. The value UA is inversely proportional to the sensible heat ratio SHR and linearly related to the flow rate change of air. Consequently, the value UA can be approximated using the following equation:

$$UA = \frac{a\dot{m}_1 + b}{SHR} \quad \text{(Equation 8)}$$

In Equation 8, the variables a and b are both constants, and b has a relatively small value. Substituting Equation 8 into Equation 7 demonstrates that the bypass factor BPF is a constant:

$$BPF = \frac{a\dot{m}_1 + b}{e^{c_{P_1}\dot{m}_1}} \quad \text{(Equation 9)}$$

Because the bypass factor BPF is a constant for a given coil of the evaporator 28, its value can be determined either by experiment or by the design model. Using the known bypass factor BPF value and Equation 1, the outlet temperature of the air exiting the evaporator $T_{1out}$ can be calculated using the following equations:

$$T_{1out} = BPF(T_{1in} - T_s) + T_s \text{ when the evaporator } \mathbf{28} \text{ is a cooling coil} \quad \text{(Equation 10)}$$

$$T_{1out} = T_s - BPF(T_s - T_{1in}) \text{ when the evaporator } \mathbf{28} \text{ is a heating coil} \quad \text{(Equation 11)}$$

After calculating the outlet temperature of the air exiting the evaporator $T_{1out}$, the relative humidity of the air entering the evaporator $RH_1$ and the relative humidity of the air exiting the evaporator $RH_2$ can be estimated.

Figure 5:
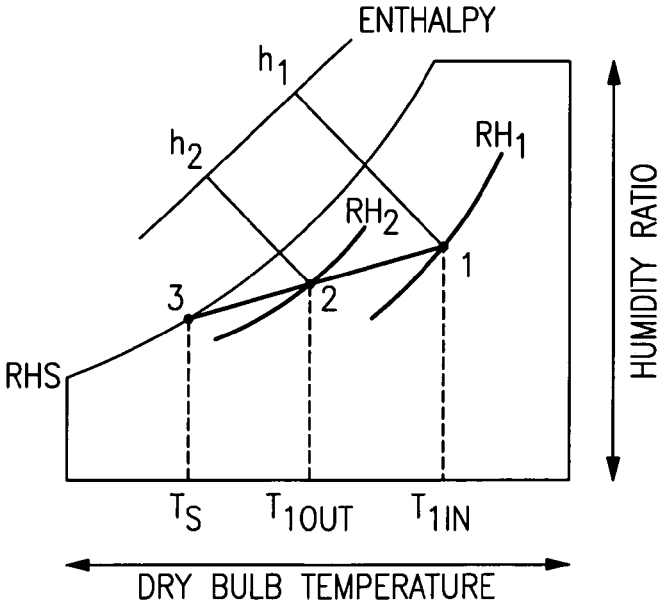
FIG. 5 illustrates a psychrometric chart showing the procedure for estimating the relative humidity of the air entering and exiting the evaporator.

FIG. 5 illustrates a psychrometric chart showing the procedure for estimating the relative humidity of the air entering the evaporator $RH_1$ and the relative humidity of the air exiting the evaporator $RH_2$. The dry bulb temperature is on the horizontal axis, and the humidity ratio is on the vertical axis. Points representing the saturation temperature of the air $T_s$, the inlet temperature of the air exiting the evaporator $T_{1in}$ and the outlet temperature of the air exiting the evaporator $T_{1out}$ are plotted along the horizontal axis. The saturation line RHs is also shown.

A vertical line extending from the saturation temperature of the air $T_s$ intersects the saturation line RHs at a point 3. The coil of the evaporator 28 is designed such that the air exiting the evaporator 28 is near saturation, and the relative humidity of the air exiting the evaporator $RH_2$ is approximately 95% of the saturation line RHs. Therefore, the relative humidity line $RH_2$ is known, assuming it to be 95% of the saturation line RHs. The outlet temperature of the air exiting the evaporator $T_{1out}$ was previously calculated using the bypass factor BPF and the inlet temperature of the air entering the evaporator $T_{1in}$. Therefore, point 2 can be found on the chart at the intersection of a vertical line extending from the outlet temperature of the air exiting the evaporator $T_{1out}$ and the relative humidity line $RH_2$.

A line connecting point 2 and point 3 is extended until it intersects a vertical line extending vertically from the inlet temperature of the air entering the evaporator $T_{1in}$ at point 1. Point 1 represents the relative humidity of the air entering the evaporator $RH_1$. The relative humidity line $RH_1$ can then be determined as it passes through point 1.

If the vapor compression system 20 is operating in a heating mode, the relative humidity $RH_1$ and the relative humidity $RH_2$ do not change and can be calculated using the above-described method. Therefore, only the outlet temperature of the air exiting the evaporator $T_{1out}$ needs to be calculated to determine the load requirement of the vapor compression system 20.

By using the existing sensors 34, 36, 38, 40, 42, 44 and 46 in the vapor compression system 20 to determine the outlet temperature of the air exiting the evaporator $T_{1out}$, the relative humidity of the air entering the evaporator $RH_1$, and the relative humidity of the air exiting the evaporator $RH_2$, additional sensors do not need to be added to the vapor compression system 20 to determine these values, reducing the cost and increasing accuracy. By determining these values using the existing sensors 34, 36, 38, 40, 42, 44 and 46, the load requirement of the vapor compression system 20 can be calculated. Therefore, system capacity of the vapor compression system 20 can be matched to the load requirement by controlling the compressor 22, allowing for effective use of electric power without the use of additional sensors.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A method of estimating an air condition of a vapor compression system, the method comprising the steps of:

detecting an inlet temperature of air entering an evaporator; and determining an outlet temperature of the air exiting the evaporator, based at least partially on the inlet temperature of the air entering the evaporator to calculate a load demand of the vapor compression system.

2. The method as recited in claim 1 further including the steps of:

compressing a refrigerant to a high pressure in a compressor;

cooling the refrigerant;

expanding the refrigerant; and evaporating the refrigerant in the evaporator.

3. The method as recited in claim 2 including at least one of the steps of:

detecting a suction temperature of the refrigerant entering the compressor, detecting a suction pressure of the refrigerant entering the compressor, detecting a discharge temperature of the refrigerant exiting the compressor, detecting a discharge pressure of the refrigerant exiting the compressor, detecting an inlet temperature of the refrigerant entering the evaporator, and detecting an outlet temperature of the refrigerant exiting the evaporator.

4. The method as recited in claim 1 further including the step of determining a bypass factor of the evaporator, wherein the bypass factor represents an amount of the air that is bypassed without direct contact with the evaporator.

5. The method as recited in claim 4 wherein the bypass factor depends upon a number of fins of the evaporator, a number of rows in the evaporator, and a velocity of the air, and the bypass factor is a constant value.

6. The method as recited in claim 1 further including the step of controlling a compressor to match a system capacity of the vapor compression system to the load demand.

7. The method as recited in claim 1 further including the step of determining a relative humidity of the air entering the evaporator and a relative humidity of the air exiting the evaporator.

8. The method as recited in claim 1 wherein the step of determining the outlet temperature of the air exiting the evaporator includes calculating the outlet temperature of the air exiting the evaporator.

9. A method of estimating air conditions of a vapor compression system, the method comprising the steps of:

detecting a condition of the vapor compression system;

determining at least one of an outlet temperature of the air exiting an evaporator, a relative humidity of the air entering the evaporator, and a relative humidity of the air exiting the evaporator based on the condition to calculate a load demand of the vapor compression system; and determining a bypass factor of the evaporator, wherein the bypass factor represents an amount of air that is bypassed without direct contact with the evaporator, wherein the bypass factor depends upon a number of fins of the evaporator, a number of rows in the evaporator, and a velocity of the air, and the bypass factor is a constant value, wherein the outlet temperature of the air exiting the evaporator is defined as $$T_{1out}=BPF(T_{1in}-T_s)+T_s,$$

wherein BPF is the bypass factor, $T_{1out}$ is the outlet temperature of the air exiting the evaporator, $T_{1in}$ is the inlet temperature of the air entering the evaporator, and $T_s$ is a saturation temperature of the air.

10. The method as recited in claim 9 wherein the saturation temperature of the air is substantially equal to a saturation temperature of the refrigerant.

11. The method as recited in claim 10 wherein the relative humidity of the air exiting the evaporator is approximately 95% of a relative humidity of the air at the saturation temperature of the air.

12. The method as recited in claim 11 further including the step of determining the relative humidity of the air entering the evaporator based on the inlet temperature of the air entering the evaporator, the outlet temperature of the air exiting the evaporator, the relative humidity of the air exiting the evaporator, and the saturation temperature of the refrigerant.

13. A method of estimating air conditions of a vapor compression system, the method comprising the steps of:

detecting a condition of the vapor compression system;

determining at least one of an outlet temperature of air exiting an evaporator, a relative humidity of the air entering the evaporator, and a relative humidity of the air exiting the evaporator based on the condition to calculate a load demand of the vapor compression system;

determining a first point of intersection of a vertical line representing a saturation temperature of the refrigerant with a saturation curve;

determining a second point of intersection of a vertical line representing the outlet temperature of the air exiting the evaporator with a curve representing the relative humidity of the air exiting the evaporator;

connecting an extension line between the first point and the second point; and extending the extension line to intersect a vertical line representing an inlet temperature of the refrigerant entering the evaporator at a third point, and the third point indicates the relative humidity of the air entering the evaporator.

14. A method of estimating air conditions of a vapor compression systems, the method comprising the steps of:

detecting an inlet temperature of air entering an evaporator, and calculating an outlet temperature of the air exiting the evaporator, a relative humidity of the air entering the evaporator, and a relative humidity of the air exiting the evaporator to calculate a load demand of the vapor compression system based on the inlet temperature of the air entering the evaporator.

15. The method as recited in claim 14 wherein the outlet temperature of the air exiting the evaporator is defined as:

$$T_{1out}=BPF(T_{1in}-T_s)+T_s,$$

wherein BPF is a bypass factor of the evaporator that represents an amount of air that is bypassed without direct contact with the evaporator, $T_{1out}$ is the outlet temperature of the air exiting the evaporator, $T_{1in}$ is the inlet temperature of the air entering the evaporator, and $T_s$ is a saturation temperature of the air, wherein the saturation temperature of the air is substantially equal to a saturation temperature of a refrigerant that exchanges heat with the air in the evaporator.

16. The method as recited in claim 15 wherein the relative humidity of the air exiting the evaporator is approximately 95% of a relative humidity of the air at the saturation temperature of the air.

17. The method as recited in claim 16 further including the steps determining the relative humidity of the air entering the evaporator based on the outlet temperature of the air exiting the evaporator, the relative humidity of the air exiting the evaporator, and the saturation temperature of the refrigerant.

18. The method as recited in claim 14 further including the steps of:

determining a first point of intersection of a vertical line representing a saturation temperature of the refrigerant with a saturation curve, determining a second point of intersection of a vertical line representing the outlet temperature of the air exiting the evaporator with a curve representing the relative humidity of the air exiting the evaporator, connecting an extension line between the first point and the second point, and extending the extension line to intersect a vertical line representing the inlet temperature of the refrigerant entering the evaporator at a third point, and the third point indicates the relative humidity of the air entering the evaporator.

19. The method as recited in claim 14 further including the step of controlling a compressor to match a system capacity of the vapor compression system to the load demand.

* * * * *

UNITED STATES PATENT AND TRADEMARK OFFICE

CERTIFICATE OF CORRECTION

PATENT NO. : 7,219,506 B2
APPLICATION NO. : 10/973009
DATED : May 22, 2007
INVENTOR(S) : Kang et al.

It is certified that error appears in the above-identified patent and that said Letters Patent is hereby corrected as shown below:

Claim 14, Column 8, line 55: “systems” should read as --system--

Signed and Sealed this

Thirty-first Day of July, 2007

JON W. DUDAS
*Director of the United States Patent and Trademark Office*